US006005202A

United States Patent [19]

Drexler et al.

[11] Patent Number: 6,005,202

[45] Date of Patent: Dec. 21, 1999

[54] SWITCHING DEVICE HAVING AN UNLOCKING DEVICE

[75] Inventors: Johann Drexler, Schwandorf; Norbert Sörgel; Ralph-Ronald Göbel, both of Amberg, all of Germany

[73] Assignee: Siemens Aktiengesellschaft, Munich, Germany

[21] Appl. No.: 09/091,092

[22] PCT Filed: Dec. 2, 1996

[86] PCT No.: PCT/DE96/02316

§ 371 Date: Jun. 11, 1998

§ 102(e) Date: Jun. 11, 1998

[87] PCT Pub. No.: WO97/22985

PCT Pub. Date: Jun. 26, 1997

[30] Foreign Application Priority Data

Dec. 15, 1995 [DE] Germany ..... 195 47 011

[51] Int. Cl.[6] ..... H01H 9/26

[52] U.S. Cl. ..... 200/50.33; 200/50.36; 200/552

[58] Field of Search ..... 200/50.33, 50.36, 200/50.32, 50.28, 50.01, 552, 321, 323, 318, 327

[56] References Cited

U.S. PATENT DOCUMENTS

| | | | |
|---|---|---|---|
| 3,428,764 | 2/1969 | Drees et al. | 200/50.33 X |
| 4,385,214 | 5/1983 | Sullivan . | |
| 4,409,575 | 10/1983 | Hisadome | 200/50.33 X |
| 4,720,614 | 1/1988 | Wulff | 200/552 |

FOREIGN PATENT DOCUMENTS

| | | |
|---|---|---|
| 1 338 932 | 1/1994 | France . |
| 1 447 403 | 10/1968 | Germany . |
| 2 440 361 | 3/1976 | Germany . |
| 24 40 361 | 3/1976 | Germany . |
| 41 42 179 | 6/1993 | Germany . |

*Primary Examiner*—Renee S. Luebke
*Attorney, Agent, or Firm*—Kenyon & Kenyon

[57] ABSTRACT

A device in which a triggered switching device (1), for example a contactor, may be maintained in its ON position even if the power supply is interrupted. The invention includes a mechanical locking system having a pawl (11), which is held in a bearing (12). When the switching device (1) is triggered, the pawl (11) engages under the loading of spring force in a recess (5) in a contact carrier (4). It is possible via an unlocking device (7) to actuate an angle lever (16) which pivots the pawl (11) and releases the contact carrier (4). Unlocking can also be performed by hand via an ON-OFF indicator (23) of a second contact carrier (8). The bearing (12) may be shape-coded to ensure that it is installed properly oriented in the openings (13, 14) of the side walls (3, 6) of the switching device (1) and the locking device (7).

8 Claims, 3 Drawing Sheets

SWITCHING DEVICE HAVING AN UNLOCKING DEVICE

FIELD OF THE INVENTION

The present invention relates to a switching device having a first moveable contact carrier which has a first recess, in which, depending on the operating state, a latch engages under the loading of a spring force via a first housing opening of the switching device.

RELATED TECHNOLOGY

DE-A 14 47 403 has discloses a mutual mechanical locking system for two components, for example for two contactors. The two components are held in a freely moveable fashion in such a way that when one component is moved out of the rest position by a force exerted on it, the other component has its movement blocked. Mounted between the two components are two displaceable elements which are both held against a spring force by magnets fitted reciprocally on the components. Latching points are provided reciprocally on the components in such a way that one component latches tight with an appropriate element as soon as the other component leaves the rest position when the magnet action is canceled with respect to this element.

U.S. Pat. No. 4,385,214 discloses two push buttons which are connected to one another by a locking mechanism. This ensures that in each case only the contact of one push button can be closed while that of the other push button remains in the open state.

DE 24 40 361 B2 discloses a switching device with a mechanical locking system of moveable parts. What is disclosed is a mechanical locking system of parts which can be moved in parallel and moved to and fro, for example of switching inserts in switching devices, which locking requires no special adjusting measures and is easy to assemble by the customer. It is ensured by means of a locking piece that, for example, as parts which can be moved in parallel and are to be locked operating heads of a contactor cannot simultaneously be located in the ON position. Rather, only one operating head can be in the ON position, while the other one is held in the OFF position.

A problem with switching devices, such as contactors, is that after switching on has been performed the moveable contact carrier must be held in the ON position even if an interruption occurs in the power supply to the switching device.

SUMMARY OF THE INVENTION

It is therefore an object of the present invention in conjunction with a switching device including a contract carrier to provide a mechanical locking system which, after the switching device has been switched on, maintains the ON position of the contact carrier in the event of failure of the power supply. A further aim of the present invention is to construct the switching device such that the mechanical locking system can be deactivated with the aid of an electric signal.

The present invention therefore provides a switching device in which, upon transition of the switching device into the ON position, a latch engages in a first recess via a first housing opening of the switching device, the switching device being connected to an unlocking device which has a second moveable contact carrier, having a second recess, in which a first arm of a rotatably mounted angle lever engages in the OFF position via a second housing opening in the unlocking device. When the unlocking device is switched on said angle lever is pivoted round in such a way that it actuates the latch by means of its second arm and thus releases the first contact carrier.

It is advantageous when the latch is designed as a pawl which is rotatably mounted in a bearing, since the pawl can be constructed as a part requiring little room, and the bearing can be used in the same design as in the case of turning combinations, for example of contactors. As a result, the bearing is a part which can be produced cost-effectively in high batch quantities.

If there is provided for loading the latch with spring force a spring which acts on the latch, on the one hand, and on the housing of the unlocking device, on the other hand, the force for pivoting the latch is provided in a particularly simple way.

The switching device and the unlocking device are advantageously implemented in each case by a contactor.

It is advantageous, furthermore, when the first housing opening is provided in a first side wall of the switching device, and when the second housing opening is provided in a second side wall of the unlocking device. It is possible with this arrangement to extend the first switching device, for example a contactor, using an auxiliary switch mounting kit for the front side. Moreover, the design of the front side of the device can be retained, and the risk of pollution can be kept low.

If the bearing is shape-coded and if the switching device and the unlocking device have in the first and second side walls openings which are adapted to the shape coding and in which the bearing is held in a self-closed fashion, it is possible in this way to prevent the bearing and the pawl from being constructed with their sides reversed.

BRIEF DESCRIPTION OF THE DRAWINGS

An exemplary embodiment of the present invention is explained below in more detail with the aid of the drawings, in which.

DETAILED DESCRIPTION

Figure 1:
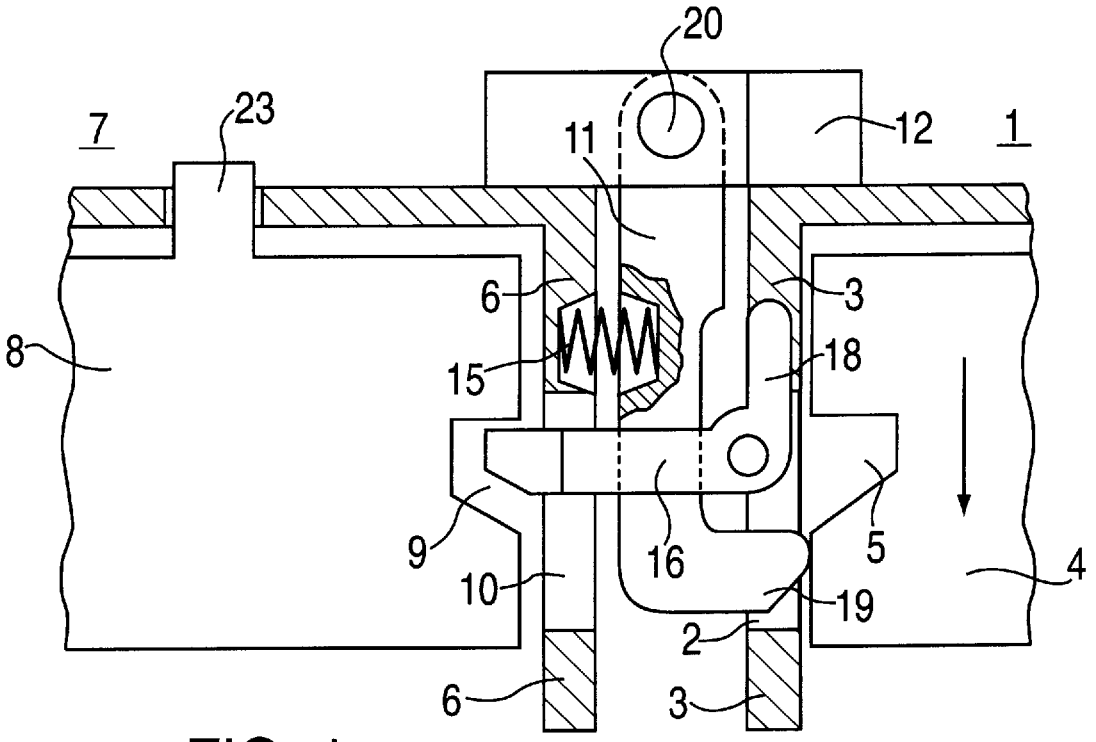
FIG. 1 shows a detail of an embodiment of a switching device of an apparatus of the present invention comprising a switching device and an unlocking device and having a mechanical locking system, in the OFF state.
Figure 5:
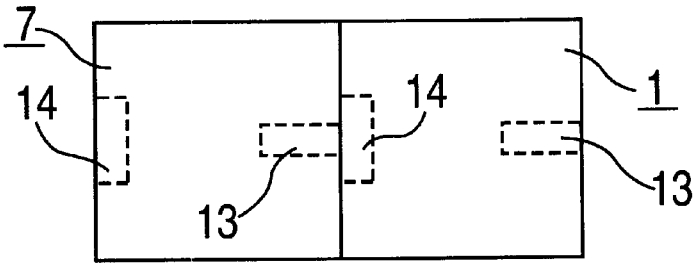
FIG. 5 shows a design principle for housing openings in the side walls of the switching device and for the unlocking device for holding a shape-coded bearing of the mechanical locking system.

FIG. 1 shows a mechanical locking system of a switching device 1, for example a contactor, of which there can be seen a detail of the housing having a first housing opening 2 in a first side wall 3, as well as a first contact carrier 4 having a first recess 5, which is situated opposite first housing opening 2. Situated parallel to first side wall 3 is a second side wall 6 of an unlocking device 7 unlocking device 7 is connected to the switching device 1 and is, for example, a further contactor and has a second contact carrier 8 with a second recess 9, which is also situated opposite a second housing opening 10 in the second side wall 6. A latch designed as a pawl 11 is mounted rotatably between two side walls 3 and 6 in a shape-coded bearing 12. Referring to FIG. 5, bearing 12 is situated in housing openings 13 and 14, adapted to its shape coding, in accordance with FIG. 5 in the side walls 3 and 6 respectively. A compression spring 15 supported on the pawl 11, on the one hand, and on the second side wall 6, on the other hand, applies to the pawl 11 a spring force acting in the direction of first side wall 3. In the OFF state represented in FIG. 1, first contact carrier 4 is in a top position and pawl 11 is supported below first recess 5 on first contact carrier 4. An angle lever 16 mounted rotatably on switching device 1 engages with its first arm 17 in second recess 9 in second contact carrier 8 of unlocking device 7. A second arm 18 of angle lever 16 is angled off with respect to the first arm by 90° between pawl 11 and first contact carrier 4.

Figure 2:
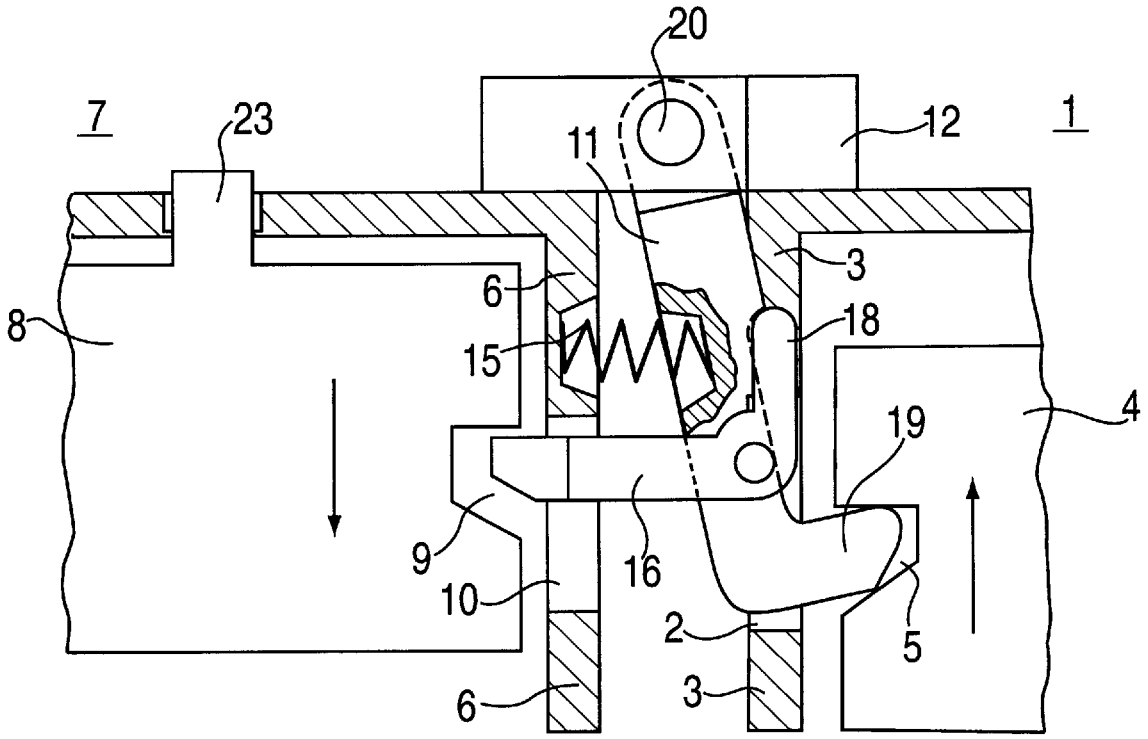
FIG. 2 shows a apparatus in accordance with FIG. 1 in the ON state of the switching device.

When the switching device 1 is switched on, first contact carrier 4 moves downwards in the direction marked by the arrow shown in FIG. 1 and assumes the ON position. When contact carrier 4 is in the ON position pawl 11 first recess 5 in first contact carrier 4 under the action of compression spring 15. Until the locking is deactivated, this ON position is maintained by pawl 11, that is to say even in the case of interruption of the power supply of the switching device 1. Provided for the purpose of unlocking pawl 11 is unlocking device 7 whose contact carrier 8 moves downwards in the direction of the arrow shown in FIG. 1 when the unlocking device 7 is switched on. Angle lever 16 is thereby rotated and by means of its second arm 18 pivots pawl 11 out of first recess 5 of first contact carrier 4, with the result that contact carrier 4 moves upwards in the direction of the arrow shown in FIG. 2. The unlocking can also be performed by hand via ON-OFF indicator 23 of contact carrier 8.

Figure 3:
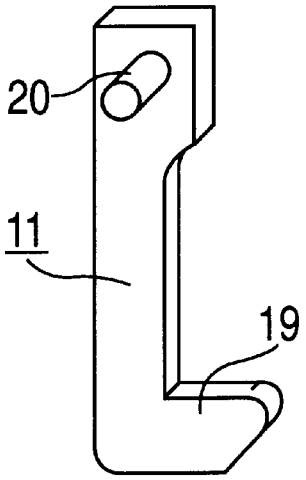
FIG. 3 shows a bearing and a pawl of the mechanical locking system according to FIG. 1.
Figure 4:
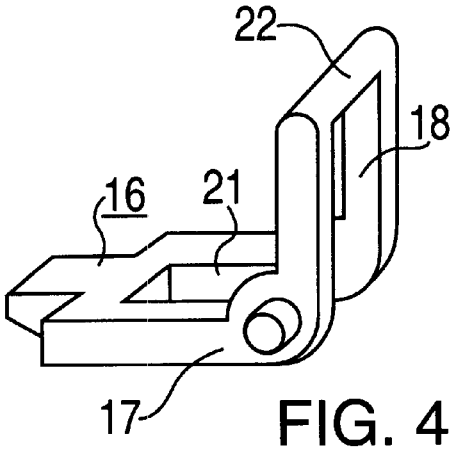
FIG. 4 shows an angle lever of the mechanical locking system according to FIG. 1.

The construction of pawl 11 and angle lever 16 is illustrated in detail in FIG. 3 and FIG. 4. Pawl 11 is rotatably mounted on bearing 12 via pins 20 and has at an end a bevelled projection 19 which for mechanical locking enters the likewise bevelled first recess 5 of first contact carrier 4. The bevels permit compensation of tolerances in a simple way. Angle lever 16 is provided with an opening 21 in which pawl 11 is disposed. Second arm 18 of angle lever 16 has at the an a web 22, which delimits the opening 21 and which pivots pawl 11 during unlocking. Referring to FIG. 5, bearing 12 may be shape-coded by being constructed in the shape of a hammer head at one end in order to ensure it is installed with its correct end in the openings 13 and 14 of matched construction in side walls 3 and 6 of switching device 1 and of locking device 7, respectively.

Figure 6:
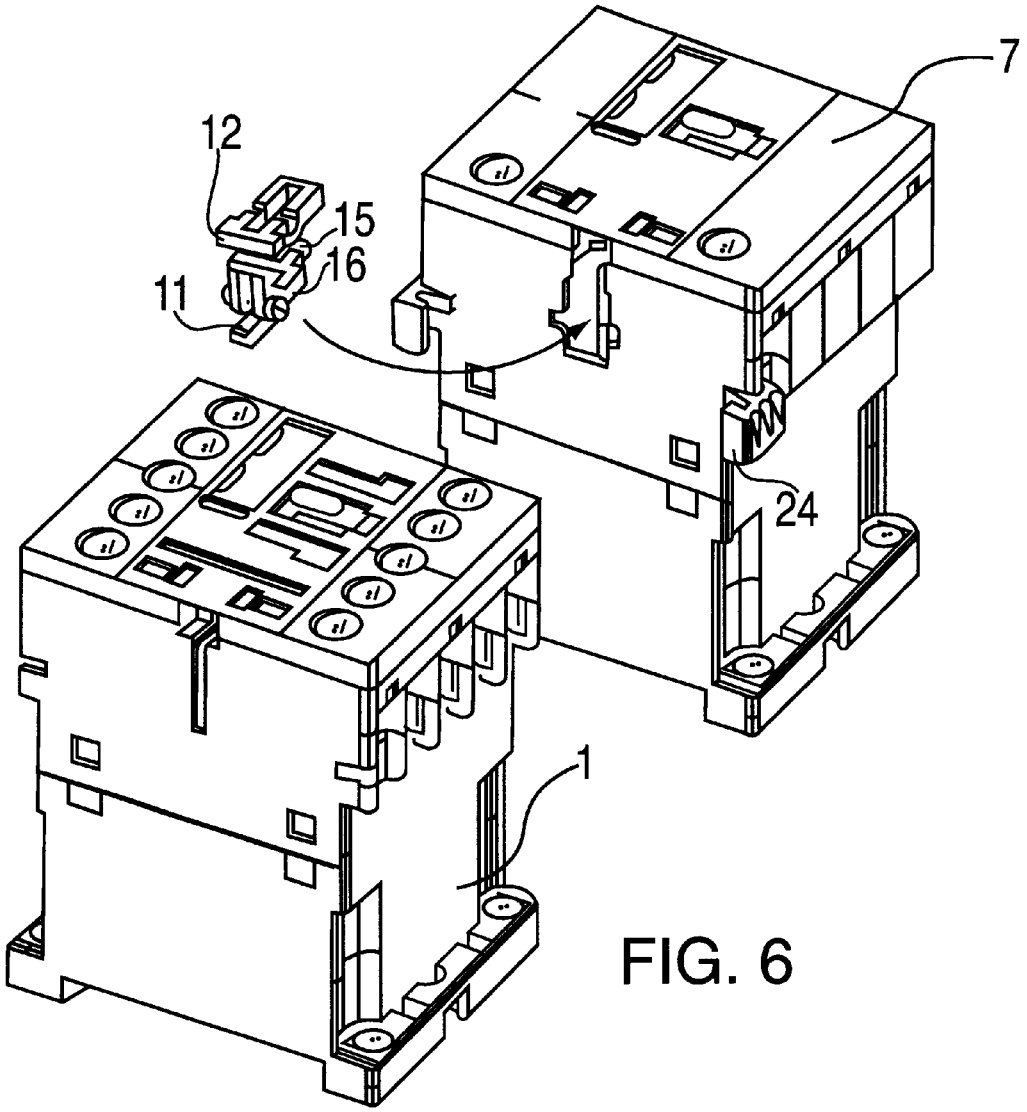
FIG. 6 shows an exploded representation of an embodiment of a switching device of the present invention having a mechanical locking system and having an unlocking device.
Figure 7:
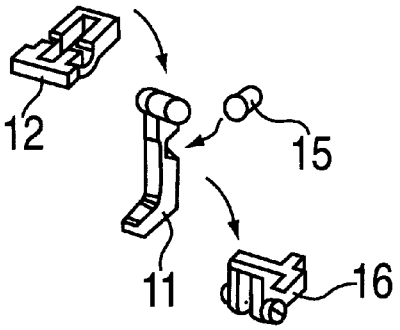
FIG.7 illustrates an exploded view of a portion of the mechanical locking system according to the present invention.

An embodiment of the present invention in which switching device 1 is a contractor having individual parts pawl 11, bearing 12, spring 15, and angle lever 16 required for mechanical locking and unlocking is represented together with unlocking device 7 in FIG. 6. The contactor and unlocking device 7 are held together via connecting elements 24, which are clamped on laterally projecting ribs.

The design according to the present invention of the mechanical locking and unlocking system is distinguished in that it is possible to use mass produced contactors as switching device and as unlocking device. Fitting a contactor with a mechanical locking system can be done quickly in a simple way using few parts.

What is claimed is:

1. A switching apparatus comprising:

a switching device, the switching device having ON and OFF positions and including:

a first moveable contact carrier having a first recess, a first housing having a first housing opening, and a latch for engaging, depending on an operating state, the first recess under loading of a spring force via the first housing opening, the latch engaging the first recess upon transition of the switching apparatus into the ON position;

an unlocking device connected to the switching device, the unlocking device including:

a second housing having a second housing opening, and a second moveable contact carrier having a second recess; and a rotatably mounted angle lever having a first arm and a second arm, the first arm engaging the second recess via the second housing opening when the switching device is in the OFF position, the angle lever pivoting to actuate the latch via the second arm to release the first contact carrier when the unlocking device is switched on.

2. The switching apparatus as recited in claim 1 wherein the housing includes a locking device housing and further comprising a spring for loading the latch with the spring force, the spring acting on the latch and on the locking device housing.

3. The switching apparatus as recited in claim 1 wherein the switching device and the unlocking device each include a contactor.

4. The switching apparatus as recited in claim 1 wherein the housing includes a first side wall and a second side wall, the first housing opening being disposed in the first side wall, the second housing opening being disposed in the second side wall.

5. The switching apparatus as recited in claim 1 further comprising a bearing for supporting the latch, the bearing being shape-coded.

6. The switching apparatus as recited in claim 1, wherein the first housing includes a first side wall having a first side wall opening and the second housing includes a second side wall having a second side wall opening, the first side wall opening and second side wall opening being adapted to a shape coding of a bearing, the bearing being held in the first side wall opening and the second side wall opening in a self-closed fashion.

7. The switching apparatus as recited in claim 1 wherein the latch includes a pawl, the pawl being rotatably mounted in a bearing.

8. The switching apparatus as recited in claim 7 wherein the housing includes a locking device housing and further comprising a spring for loading the pawl with a spring force, the spring acting on the pawl and on the locking device housing.

* * * * *